United States Patent [19]

Hochhauser

[11] Patent Number: 4,519,809

[45] Date of Patent: May 28, 1985

[54] METHOD FOR REDUCING WATER SENSITIVITY OF ETHER CONTAINING GASOLINE COMPOSITIONS

[75] Inventor: Albert M. Hochhauser, Edison, N.J.

[73] Assignee: Exxon Research & Engineering Co., Florham Park, N.J.

[21] Appl. No.: 603,077

[22] Filed: Apr. 23, 1984

[51] Int. Cl.[3] ..... C10L 1/02

[52] U.S. Cl. ..... 44/53

[58] Field of Search ..... 44/53, 56

[56] References Cited

U.S. PATENT DOCUMENTS

| | | | |
|---|---|---|---|
| 2,132,017 | 10/1938 | Evans | 23/250 |
| 2,384,796 | 9/1945 | Carmody et al. | 44/53 |
| 2,391,084 | 12/1945 | Carmody | 44/53 |
| 2,409,746 | 10/1946 | Evans et al. | 44/56 |
| 2,575,543 | 11/1951 | Young | 44/56 |
| 2,952,612 | 9/1960 | Trainer | 44/56 |
| 3,224,848 | 12/1965 | Henderson | 44/56 |
| 3,849,082 | 11/1974 | Kozlowski et al. | 44/56 |
| 4,182,913 | 1/1980 | Takezono et al. | 44/56 |
| 4,193,770 | 3/1980 | Chase et al. | 44/56 |
| 4,207,077 | 6/1980 | Bove et al. | 44/56 |
| 4,252,541 | 2/1981 | Herbstman | 44/56 |

OTHER PUBLICATIONS

Guthrie (Editor), "Petroleum Products Handbook," 1960, p. 423, Table.

*Primary Examiner*—Mrs. Y. Harris-Smith

*Attorney, Agent, or Firm*—Eugene Zagarella

[57] ABSTRACT

A method for reducing the water sensitivity of an ether containing gasoline composition comprising mixing the ether component after it is prepared and while it is essentially water free with a selected paraffinic component before it is added to the gasoline.

10 Claims, No Drawings

METHOD FOR REDUCING WATER SENSITIVITY OF ETHER CONTAINING GASOLINE COMPOSITIONS

BACKGROUND OF THE INVENTION

This invention relates to a method for reducing the water sensitivity of gasoline compositions which contain either additives.

The use of alkyl ethers to improve the octane ratings of gasoline compositions has been known for some time. This use has become of increased interest in recent years because of the environmental problems associated with lead and the resulting need to remove lead containing products from gasoline. While the removal of lead, and particularly tetraethyl lead, from gasoline, has alleviated the environmental problem, it has caused a reduced octane rating for the resulting fuel. This has necessitated the addition of other lead-free additives to gasoline to maintain the desired octane value.

Various attempts to prepare ethers and fuel compositions containing them have been disclosed in the art as illustrated for example in U.S. Pat. No. 4,182,913, 4,193,770, and 4,252,541. This use of ethers as components in gasoline to provide a relatively high octane fuel has generally wet with success. However, a problem of water sensitivity resulting in haze formation has developed in some instances when the ether is blended with the gasoline fuel. This is probably to some extent the result of the water solubility of ethers and the presence of significant amounts of water in storage and shipping tanks. Accordingly, there is the need to provide ether containing gasoline compositions which have reduced water sensitivity and satisfactory octane ratings.

SUMMARY OF THE INVENTION

Now in accordance with the method of this invention, it has been found that the water sensitivity of an ether containing gasoline composition can be reduced by mixing said ether after it is prepared and while it is essentially water free with a selected paraffinic hydrocarbon component before it is added to the gasoline. More particularly, this invention is directed to a method for reducing the water sensitivity of an ether containing gasoline composition which comprises mixing an alkyl ether component having alkyl groups of 1 to 7 carbon atoms after it is prepared and while it is essentially water free with at least 40% by volume of a branched chain paraffin having up to 11 carbon atoms, before it is added to the gasoline.

DETAILED DESCRIPTION OF THE INVENTION

This invention is directed to a method for reducing the water sensitivity of an ether containing gasoline composition wherein the ether component is mixed with a selected paraffin hydrocarbon component while it is essentially water free and before it is added to the gasoline composition.

It is known that ethers are particularly alkyl ethers can be used to improve the octane ratings of gasoline. The alkyl ethers used in the method of this invention will generally be dialkyl ethers having 1 to 7 carbon atoms in each alkyl group. More particularly, the ethers of this invention will be dialkyl ethers wherein one alkyl group will be a branched chain of 4 to 6 carbons and the other alkyl will contain 1 to 3 carbon atoms in a straight or branched chain. Preferred dialkyl ethers will be those having one branched chain of 4 to 5 carbons and more preferably a tertiary alkyl radical of 4 to 5 carbons. Most preferred are those ethers having a tertiary butyl radical. Ilustrative ethers as described which are useful in this invention are methyl tertiary-butyl ether, methyl tertiary-amyl ether, methyl tertiary-hexyl ether, ethyl tertiary-butyl ether, n-propyl tertiary-butyl ether, isopropyl tertiary-butyl ether and isopropyl tertiary-amyl ether. Methyl tertiary-butyl ether is the most preferred ether.

The preparation of ethers is well known and they may typically be obtained from alcohols by catalytic dehydration, from olefins by controlled catalytic hydration and by the Williamson synthesis where alkoxides are reacted with alkyl halides or alkyl sulfates.

The selected hydrocarbon component that is mixed with the ethers in accordance with the method of this invention is a branched chain paraffin derived from the alkylation of an isoparaffin and an olefin. Generally the branched paraffins have up to 11 carbon and more particularly 6 to 11 carbons, preferably 7 to 9 carbon atoms. These branched paraffins are obtained by alkylation of isoparaffins having 4 to 6 carbon atoms and olefins having 2 to 5 carbon atoms. the preferred paraffins are obtained when isobutane is alkylated with olefins of 3 to 5 carbon atoms. Illustrative paraffins useful in this invention are 2,3 dimethyl butane; 2,4 dimethyl pentane; 2,3 dimethylpentane; dimethyl hexanes; 2,2,4-trimethylpentane; 2,3,3 trimethylpentane; 2,3,4 trimethylpentane; 2,3 dimethylexane; 2,4 dimethylhexane and 2,2,5 trimethylhexane.

The branched paraffins as described above can be obtained from well known alkylation processes wherein catalytic alkylation of an isoparaffin with an olefin takes place. Typical commercial operations have involved sulfuric acid and hydrofluoric acid alkylation. By electing components and proper conditions, desired branched hydrocarbons can be obtained. Further disclosure of alkylation techniques of this type are described in KIRK-OTHMER, ENCYCLOPEDIA OF CHEMICAL TECHNOLOGY, Vol. 15, 1968, pp 41–44.

The gasoline composition used in the method of this invention is generally a petroleum hydrocarbon fuel useful as both a motor and aviation gasoline. Such fuels typically comprise mixtures of hydrocarbons of various types including straight and branched chain paraffins, olefins, aromatics and naphthenic hydrocarbons. These compositions are provided in a number of grades and are typically derived from petroleum crude oil by conventional refining and blending processes such as straight run distillation, thermal cracking, hydrocracking, catalytic cracking and various reforming processes. Gasoline is generally defined as a mixture of liquid hydrocarbons having an initial boiling point in the range of about 70° to 135° F. and a final boiling point in the range of about 250° to 450° F.

The important feature of this invention involves the mixing of the ether component with the selected branched chain paraffin component while the ether is essentially water free. This means mixing the ether with the paraffin component shortly after it is prepared and before it is exposed to possible water contamination in either storage or shipping vessels. Generally, an essentially water free ether component will contain less than about 0.1% by weight of water and more particularly less than about 0.01% by weight of water. The essential aspect of this mixing step is that it must involve at least 40% by volume of the branched chain paraffin, based on the total volume of paraffin and ether. Preferably at least 40% to about 80% by volume of paraffin component will be used and more preferably from about 50% to about 70% by volume.

The amount of ether/paraffin component that is added to the gasoline is not critical and can vary widely with generally up to about 30% by volume and more particularly up to about 20% by volume of said mixed ether/paraffin combination being added to the gasoline.

The following example is further illustrative of this invention and should not be construed as being a limitation on the scope thereof.

EXAMPLE

Several samples of a mixture of methyl tertiary-butyl ether (MTBE) and a petroleum alkylate, i.e., branched chain paraffin component were saturated with water and then mixed with gasoline in such proportion that the final blend contained 7% by volume of MTBE. The samples were then observed for haze using a turbidimeter with the results as follows:

| MTBE | Alkylate | ml. of Blend | ml. of Gasoline | Haze |
|---|---|---|---|---|
| 75 vol. % | 25 vol. % | 7.8 | 92.2 | Yes |
| 65 vol. % | 35 vol. % | 10.8 | 89.2 | Yes |
| 60 vol. % | 40 vol. % | 11.7 | 88.3 | Some initially (Cleared after mixing in blender for 20 seconds.) |
| 50 vol. % | 50 vol. % | 14.0 | 86 | No |

A sample of MTBE alone, 7% by volume and saturated with water was mixed with gasoline. A deep haze developed and did not clear to a satisfactory level even after shaken in an Eberbach shaker for five minutes and allowed to settle overnight.

What is claimed is:

1. A method for reducing the water sensitivity of an ether containing gasoline composition which comprises mixing an alkyl ether component having alkyl groups of 1 to 7 carbon atoms after it is prepared and while it is essentially water free with at least 40% by volume of a branched chain paraffin component having up to 11 carbon atoms and derived from the alkylation of an isoparaffin and an olefin before it is added to the gasoline.

2. The method of claim 1 wherein the ether component is a dialkyl ether with one alkyl group being a branched chain of 4 to 6 carbon atoms and the other alkyl group containing 1 to 3 carbon atoms.

3. The method of claim 2 wherein said branched chain paraffin component contains 6 to 11 carbon atoms.

4. The method of claim 3 wherein said paraffin is obtained from the alkylation of an isoparaffin having 4 to 6 carbon atoms with an olefin of 2 to 5 carbon atoms.

5. The method of claim 3 wherein from about 50 to about 70% of said paraffin component is used in said ether/paraffin mixture.

6. The method of claim 5 wherein said ether has one branched chain alkyl group of 4 to 5 carbon atoms.

7. The method of claim 6 wherein the paraffin component has 7 to 9 carbon atoms.

8. The method of claim 7 wherein said ether is methyl tertiary-butyl ether.

9. The method of claim 8 wherein said paraffin component is derived from the alkylation of isobutane with an olefin of 3 to 5 carbon atoms.

10. The method of claim 9 wherein said ether component contains less than about 0.1 wt. % of water.

* * * * *